US009814111B1

(12) United States Patent
Huang et al.

(10) Patent No.: US 9,814,111 B1
(45) Date of Patent: Nov. 7, 2017

(54) MODULAR LIGHT CONTROL DEVICE AND DIMMING CONTROL SYSTEM

(71) Applicant: Gooee Limited, St Albans (GB)

(72) Inventors: Ji De Huang, Hsinchu (TW); Chun-Kuang Chen, Taoyuan (TW); Tung Yu Chen, Hsinchu County (TW)

(73) Assignee: Gooee Limited, St Albans (GB)

( * ) Notice: Subject to any disclaimer, the term of this patent is extended or adjusted under 35 U.S.C. 154(b) by 0 days.

(21) Appl. No.: 15/373,088

(22) Filed: Dec. 8, 2016

(30) Foreign Application Priority Data

Jun. 1, 2016 (TW) ..... 105117198 A

(51) Int. Cl.
*H05B 37/02* (2006.01)
*H05B 33/08* (2006.01)

(52) U.S. Cl.
CPC ..... *H05B 33/0845* (2013.01); *H05B 33/0815* (2013.01); *H05B 37/0272* (2013.01)

(58) Field of Classification Search
CPC ..... H05B 33/0815; H05B 33/0809; H05B 33/0803; H05B 33/0845
USPC ..... 315/291
See application file for complete search history.

(56) References Cited

U.S. PATENT DOCUMENTS 8,253,346 B2 8/2012 Budike, Jr.
8,587,212 B2 11/2013 Li et al.
8,742,686 B2 * 6/2014 Zampini, II ..... H05B 33/0857 257/13
8,805,550 B2 * 8/2014 Chemel ..... H05B 37/029 315/51
2009/0278465 A1 * 11/2009 Farmer ..... H02M 7/103 315/209 R
2010/0096993 A1 * 4/2010 Ashdown ..... F21V 29/004 315/113
2011/0248644 A1 10/2011 Welten et al.
(Continued)

FOREIGN PATENT DOCUMENTS

AU 2013204215 A1 10/2014
WO WO-2015112637 A1 7/2015

OTHER PUBLICATIONS

TW Patent Office Search Report in Taiwanese—TW Patent Application No. 105117198, p. 3 list of reference cited, Feb. 14, 2017, and attached English language relevance, 4 pgs.

*Primary Examiner* — Don Le
(74) *Attorney, Agent, or Firm* — Lisa J. Moyles; Janelle A. Bailey

(57) ABSTRACT

A modular light control device and a dimming control system are disclosed. The modular light control device comprises a power conversion module, an output module and a control module. The power conversion module has a conversion circuit and a first recognition unit. The conversion circuit receives a power source and converts the power source into a power signal. The output module has an output circuit and a second recognition unit. When the control module is electrically connected with the power conversion module and the output module, the control module distinguishes configurations of the power conversion module and the output module through the first recognition unit and the second recognition unit, respectively, and outputs a control signal according to the configuration of the output module, and the output circuit outputs a driving signal to drive a lamp according to the power signal and the control signal.

14 Claims, 3 Drawing Sheets

(56) References Cited

U.S. PATENT DOCUMENTS

| | | | | |
|---|---|---|---|---|
| 2011/0309759 | A1* | 12/2011 | Shteynberg | H05B 33/0815 315/201 |
| 2012/0043900 | A1* | 2/2012 | Chitta | H05B 41/295 315/201 |
| 2013/0141007 | A1 | 6/2013 | Wood et al. | |
| 2013/0147351 | A1 | 6/2013 | Trainor et al. | |
| 2013/0187631 | A1* | 7/2013 | Russell | G01R 19/175 324/76.77 |
| 2014/0159579 | A1* | 6/2014 | Seol | H05B 33/0809 315/85 |
| 2014/0167609 | A1 | 6/2014 | Ryu et al. | |
| 2014/0368118 | A1* | 12/2014 | Bhardwaj | H05B 33/0815 315/175 |
| 2015/0028776 | A1 | 1/2015 | McMillan | |
| 2015/0084503 | A1 | 3/2015 | Liu et al. | |
| 2015/0084547 | A1 | 3/2015 | Yeh et al. | |
| 2015/0198317 | A1* | 7/2015 | Feller | H05B 33/0842 362/249.01 |
| 2015/0216009 | A1* | 7/2015 | Lee | H05B 33/0845 315/307 |
| 2016/0057819 | A1 | 2/2016 | Wang et al. | |
| 2016/0057837 | A1 | 2/2016 | Brand et al. | |
| 2017/0105263 | A1* | 4/2017 | Xiong | H05B 33/0887 |

* cited by examiner

MODULAR LIGHT CONTROL DEVICE AND DIMMING CONTROL SYSTEM

CROSS REFERENCE TO RELATED APPLICATIONS

This non-provisional application claims priority under 35 U.S.C. §119(a) on Patent Application No(s). 105117198 filed in Taiwan, Republic of China on Jun. 1, 2016, the entire contents of which are hereby incorporated by reference in its entirety.

FIELD

A light control device and a dimming control system, and more particularly a modular light control device and a dimming control system are described herein.

BACKGROUND

Different dimming systems have different control interfaces. Generally speaking, once a certain dimming system is selected, only the control interface of this dimming system can be used. For example, when a digital address lighting interface (DALI) dimming system is adopted, the DALI control interface needs to be used. However, if the dimming system of the digital multiplex interface (DMX) 512 is used, the DMX512 control interface needs to be used. If the DMX512 dimming system is selected and the DALI control interface needs to be used, it is quite time-consuming and cost-consuming although this can be done technologically, and the ordinary technician cannot adopt this design.

SUMMARY

A modular light control device and a dimming control system is described. The modular light control device described herein has the modular characteristics, and can generate the corresponding control signals in response to different control methods, so that the better design flexibility, the ease of maintenance and the reduction of the cost can be achieved. Also, in addition to the characteristics and effects of the modular light control device, the dimming control system described herein may further perform the dimming control on the lamp through the modular light control device, and also can obtain the configuration and working state of the modular light control device at the same time.

In one embodiment, a modular light control device for driving at least one lamp is described herein. The modular light control device includes a power conversion module, an output module and a control module. The power conversion module has a conversion circuit and a first recognition unit. The conversion circuit receives a power source and converts the power source into a power signal. The output module has an output circuit and a second recognition unit. When the control module is electrically connected with the power conversion module and the output module, the control module distinguishes configurations of the power conversion module and the output module through the first recognition unit and the second recognition unit, respectively, and outputs a control signal according to the configuration of the output module. The output circuit outputs a driving signal to drive the lamp according to the power signal and the control signal.

In one embodiment, the control module further outputs another control signal to control the conversion circuit to output the power signal according to the configuration of the power conversion module.

In one embodiment, the first recognition unit or the second recognition unit comprises an address chip, a microcontroller, a pin or a latch working in conjunction with a micro switch, or a combination thereof.

In one embodiment, the output circuit has a control interface, and the control signal corresponds to a pattern of the control interface.

In one embodiment, the control interface is a digital address lighting interface, a digital multiplex interface, a 0~1V interface, a 0~10V interface or a 1~10V interface.

In one embodiment, the modular light control device further works in conjunction with a dimming control device. The dimming control device is communicated and connected with the modular light control device through a network to perform a dimming control on the lamp through the modular light control device.

In one embodiment, the dimming control device obtains the configuration and a working state of the power conversion module, the configuration and a working state of the output module or the configuration and a working state of the control module of the modular light control device through the network.

In one embodiment, the network is a wired network or a wireless network.

In one embodiment, the wireless network is a Bluetooth mesh network, a WIFI network or a Zigbee network.

In addition, a dimming control system, which includes at least one lamp, at least one modular light control device, a network and a dimming control device is provided. The modular light control device is electrically connected with the lamp, and includes a power conversion module, an output module and a control module. The power conversion module has a conversion circuit and a first recognition unit. The conversion circuit receives a power source, and converts the power source into a power signal. The output module has an output circuit and a second recognition unit. When the control module is electrically connected with the power conversion module and the output module, the control module distinguishes configurations of the power conversion module and of the output module through the first recognition unit and the second recognition unit, respectively, and outputs a control signal according to the configuration of the output module. The output circuit outputs a driving signal to drive the lamp according to the power signal and the control signal. The dimming control device obtains the configuration and a working state of the power conversion module, the configuration and a working state of the output module, or a configuration and a working state of the control module of the modular light control device through the network. Besides, the dimming control device controls the modular light control device to perform a dimming control on the lamp through the modular light control device through the network.

As mentioned above, the control module distinguishes the configurations of the power conversion module and the output module in response to different lamps and control methods (control interfaces) according to the modular design characteristic of the modular light control device in the modular light control device described herein, and thus outputs the corresponding control signal to perform the dimming control on the lamp to achieve the better design flexibility. In addition, also due to the modular design, the failure detecting process becomes simpler. In addition, upon detection of the failure of a certain module, only this module needs to be replaced with a new one without replacing the overall control device. Thus, the easy maintenance and the lower cost may be obtained. In addition, in addition to the characteristics and effects of the above-mentioned modular light control device in the dimming control system described herein, the dimming control can be performed on the lamp through the modular light control device, and the configuration and working state of the modular light control device can be obtained at the same time.

BRIEF DESCRIPTION OF THE DRAWINGS

A more particular description will be rendered by reference to specific embodiments thereof that are illustrated in the appended drawings. Understanding that these drawings depict only typical embodiments thereof and are not therefore to be considered to be limiting of its scope, exemplary embodiments will be described and explained with additional specificity and detail through the use of the accompanying drawings in which.

Various features, aspects, and advantages of the embodiments will become more apparent from the following detailed description, along with the accompanying figures.

DETAILED DESCRIPTION

Present embodiments will be apparent from the following detailed description, which proceeds with reference to the accompanying drawings, wherein the same references relate to the same elements.

Figure 1:
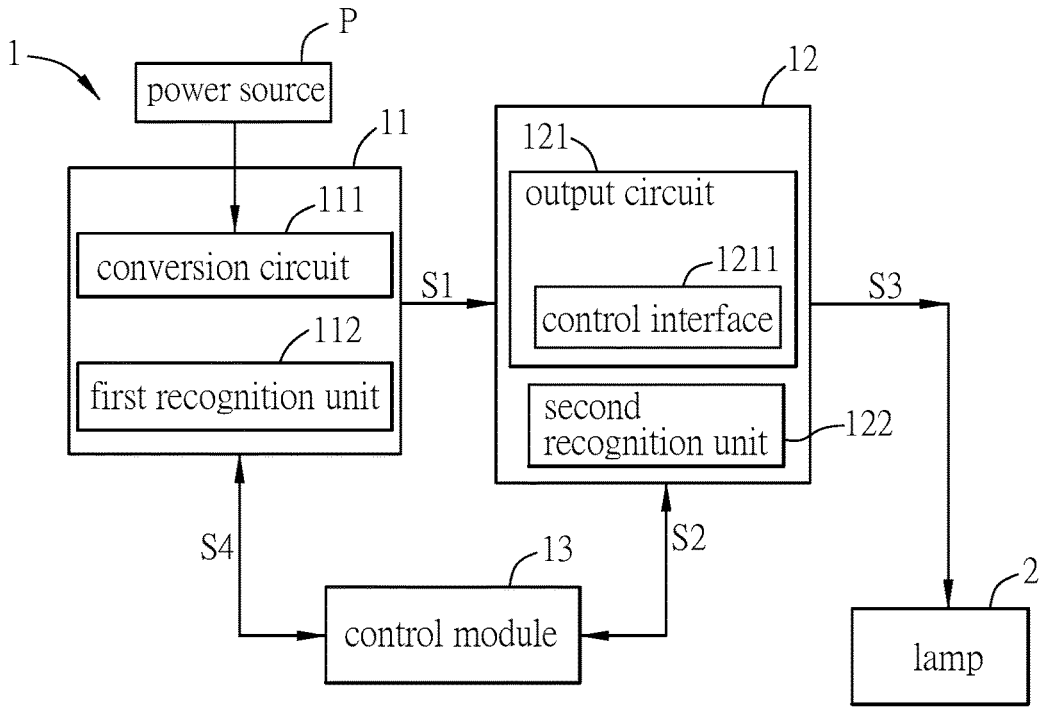
FIG. 1 is a schematic functional block diagram showing a modular light control device according to an embodiment.

FIG. 1 is a schematic functional block diagram showing a modular light control device 1 according to an embodiment.

Referring to FIG. 1, a modular light control device 1 drives at least one lamp 2 to emit light, and performs a dimming control on the lamp 2. The modular light control device 1 comprises a power conversion module 11, an output module 12 and a control module 13. The lamp 2 comprises, for example but without limitation to, a light-emitting diode (LED) lamp. In this embodiment, there are two lamps 2. In other embodiments, the number of the lamps 2 may be greater than two, and is thus not restricted thereto. In addition, the so-called "modular" property represents that each of the power conversion module 11, the output module 12 and the control module 13 has been manufactured into an individual module, so that the power conversion modules 11, the output modules 12 and the control modules 13 with different functions, types or patterns can be used to drive the lamp(s) 2 to emit light in a dimming control manner in response to different control methods, control interfaces or lamps 2.

The power conversion module 11 has a conversion circuit 111 and a first recognition unit 112. The conversion circuit 111 can receive an external power source P, and converts the power source P into a power signal S1 for output. The conversion circuit 111 of this embodiment comprises, for example but without limitation to, an AC/DC conversion circuit. Thus, different power conversion modules 11 can be selected in response to different designs of the lamps 2. For example, if the lamp 2 is the LED lamp powered by the DC power source of 12 volts, then the conversion circuit 111 can be an AC-to-DC conversion circuit for converting the 110 VAC to 12 VDC, so that the output power signal S1 has the DC 12V.

The output module 12 has an output circuit 121 and a second recognition unit 122. The output circuit 121 of this embodiment has a control interface 1211 comprising, for example but without limitation to, a dimming control interface. Different output circuits 121 have to be used in conjunction with different driving circuits (not shown) of the lamps 2. For example, when the user selects a certain lamp 2 and a control interface to perform the dimming control on the lamp 2, the output circuit 121, which can work in conjunction with the driving circuit of the lamp 2, and the corresponding control interface 1211 has to be selected.

Each of the first recognition unit 112 of the power conversion module 11 and the second recognition unit 122 of the output module 12 may comprise, for example but without limitation to, an address chip, a microcontroller (MCU), a pin (or referred to as a short-circuit pin) or a latch working in conjunction with a micro switch, or any arbitrary combination thereof. In the example of the address chip, the control module 13 can obtain the configuration content of the corresponding power conversion module 11 or output module 12 according to the address data in the address chip through a look-up table. Specifically speaking, the control module 13 can obtain the specification, model, state or control interface type, pattern and the like information of the power conversion module 11 or the output module 12 through the address chip, for example. In addition, the control interface 1211 of the output circuit 121 may be a digital address lighting interface (DALI), a digital multiplex interface (DMX) 512, a 0~1V interface, a 0~10V interface or a 1~10V interface, and thus is not restricted thereto.

In addition, the control module 13 may comprise a core control assembly of the modular light control device 1, may comprise, for example, at least one central processing unit (CPU) and a memory, or may comprise other control hardware, software or firmware. When the user selects the power conversion module 11, the output module 12 and the control module 13 in response to the dimming control requirement, and electrically connects the control module 13 with the power conversion module 11 and the output module 12, the control module 13 distinguishes configurations of the power conversion module 11 (conversion circuit 111) and the output module 12 (output circuit 121) through the first recognition unit 112 and the second recognition unit 122, respectively, and outputs a control signal S2 according to the configuration of the output module 12 (output circuit 121), and the output circuit 121 may also output a driving signal S3 to drive the lamp 2 to emit light according to the power signal S1 outputted from the conversion circuit 111 and the control signal S2 outputted from the control module 13, and performs the dimming control on the lamp 2. Because the control module 13 has recognized the configuration of the output module 12 (output circuit 121), the control module 13 may also obtain which interface the control interface 1211 of the output circuit 121 is, and makes the control signal S2 generated thereby correspond to the pattern of the control interface 1211.

For example, when the control interface 1211 is the DALI control interface and the user wants to apply the DALI interface to control the lamp 2, the power conversion module 11, the output circuit 121 (comprising the DALI interface) and the corresponding control module 13 may be selected to work in conjunction with the lamp 2 and its driving circuit, and the control module 13 is connected with the power conversion module 11 and the output module 12. Because the power conversion module 11 has the first recognition unit 112 and the output module 12 has the second recognition unit 122, the control module 13 can distinguish the configurations of the power conversion module 11 and the output module 12 (the configuration of the power conversion module 11 may comprise the type and function of the conversion circuit 111, the configuration of the output module 12 may comprise the types and functions of the output circuit 121 and the control interface 1211) through the first recognition unit 112 and the second recognition unit 122, respectively, and the control module 13 can obtain that the interface used thereby is the DALI interface when the types and functions of the output circuit 121 and the control interface 1211 are obtained, and thus can output the control signal S2 corresponding to the DALI interface in response to the DALI interface. Thus, the output circuit 121 can generate the driving signal S3 according to the power signal S1 outputted from the conversion circuit 111 and the control signal S2 outputted from the control module 13 to drive the lamp 2 and perform the dimming control through the driving signal S3.

In addition, because the control module 13 obtains the configuration of the power conversion module 11, the control module 13 also outputs another control signal S4 to control the conversion circuit 111 to output the power signal S1 according to the configuration of the power conversion module 11. For example, the control signal S4 is a pulse width modulation (PWM) signal, and the control signal S4 (PWM signal) outputted from the control module 13 may control the switching of a switch element (not shown) of the conversion circuit 111 (control the timings of turning on and turning off), so that the conversion circuit 111 can output the stable power signal S1 to the output module 12 according to the PWM technology.

As mentioned hereinabove, the modular design characteristic of the modular light control device 1 of this embodiment is applied. When the user selects a certain lamp and a certain control method (interface), the control module 13 distinguishes the configurations of the power conversion module 11 and the output module 12 in response to different lamps and control methods, and thus outputs the corresponding control signal to perform the dimming control on the lamp 2, so that the better design flexibility can be achieved. In addition, the modular design can make the detection process of the troubleshooting process become simpler. In addition, if the failure of a certain module is detected, then the module only needs to be replaced with a new one without replacing the overall control device. Thus, the embodiment may also have the easy maintenance property and the lower cost.

It is to further be additionally described that the variations of the circuit of the output module 12 are much more diversified in response with different lamps 2 and the driving circuits thereof, so more types of parts need to be prepared in stock to satisfy the requirements on the control interface and maintenance in response to different lamps 2. However, the variations of the circuits of the power conversion module 11 and the control module 13 are not significant, and it is unnecessary to prepare too many types of parts in stock. Thus, the modular light control device 1 described herein may have the advantage of the fewer parts in stock.

Figure 2:
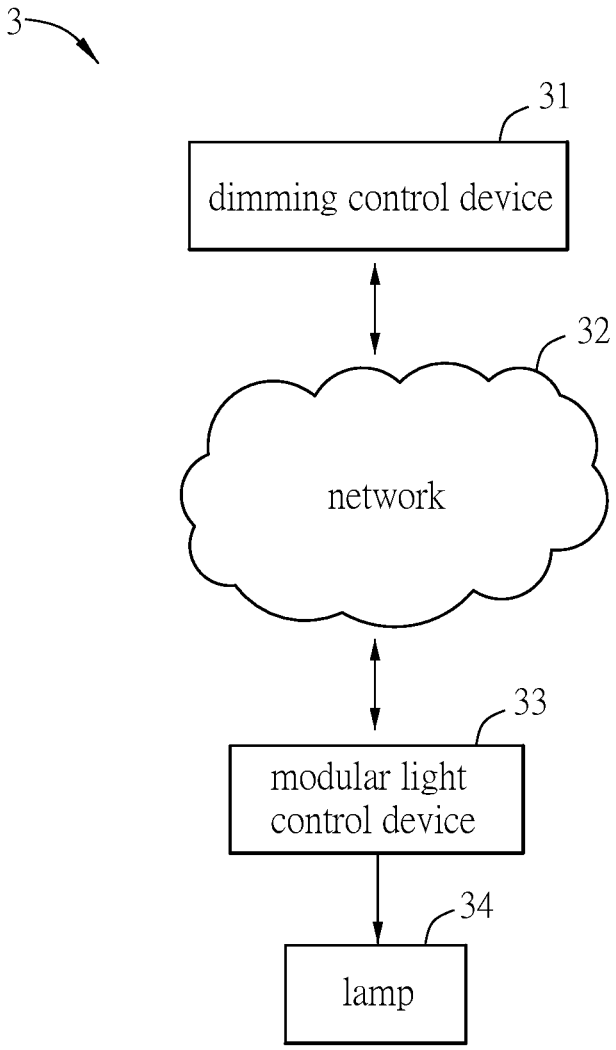
FIGS. 2 and 3 are schematic functional block diagrams showing dimming control systems according to different implementation aspects.
Figure 3:
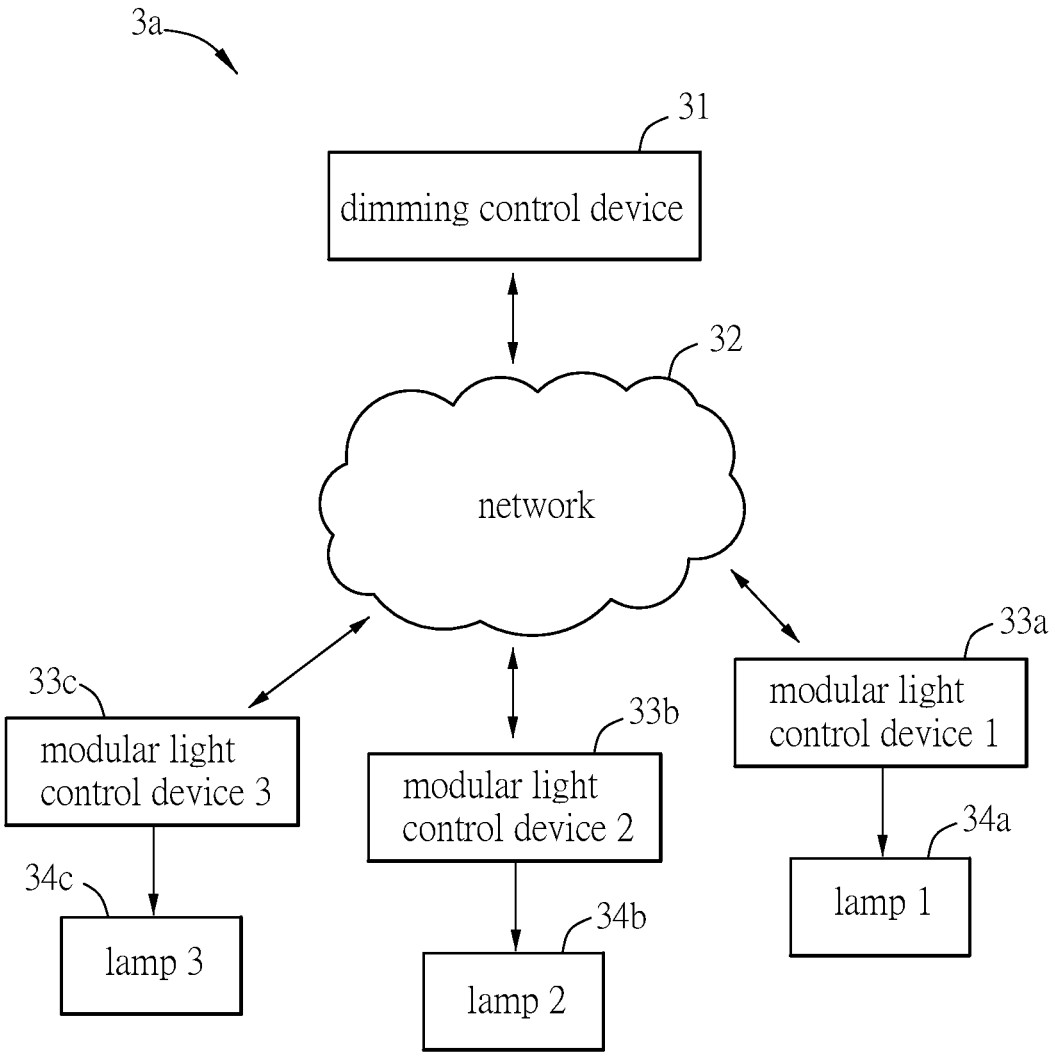

FIGS. 2 and 3 are schematic functional block diagrams showing dimming control systems 3 and 3*a* according to different implementation aspects.

Referring to FIG. 2, a dimming control system 3 comprises a dimming control device 31, a network 32, at least one modular light control device and at least one lamp. The dimming control system 3 of this embodiment comprises a modular light control device 33 and a lamp 34 electrically connected with each other. The modular light control device 33 and the lamp 34 may be the above-mentioned modular light control device 1 and lamp 2, respectively, or the modified aspects thereof. The detailed technological contents may be found hereinabove, and detailed descriptions thereof will be omitted.

In addition, each of the dimming control device 31 and the modular light control device 33 may have a network unit (not shown) capable of being connected to the network 32, so that the dimming control device 31 can be communicated and connected to the modular light control device 33 through the network 32. The dimming control device 31 may be, for example but without limitation to, a smart electronic device, such as a computer, a mobile phone, a tablet computer or the like. The network 32 may be a wired network (e.g., Transmission Control Protocol/Internet Protocol: TCP/IP) or a wireless network. The wireless network may be, for example but without limitation to, a Bluetooth mesh (BLE Mesh) network, a WIFI network or Zigbee network.

Therefore, the dimming control device 31 may obtain the configuration of the power conversion module, the output module or the control module of the modular light control device 33 (e.g., the model and the type of the power conversion module, the output module or the control module, the type of the control interface or the like) and the working state (e.g., normal or abnormal state) through the network 32, and can control the modular light control device 33 through the network 32 to perform the dimming control on the lamp 34 through the modular light control device 33.

In addition, as shown in FIG. 3, what is different from the dimming control system 3 of FIG. 2 is that the dimming control system 3*a* of this embodiment comprises three modular light control devices 33*a*, 33*b* and 33*c*, wherein the three modular light control devices 33*a*, 33*b* and 33*c* control the three lamps 34*a*, 34*b* and 34*c*, respectively, but contemplated embodiments are not restricted thereto. In different embodiments, the dimming control system may also comprise, for example but without limitation to, two or more than three modular light control devices to control the corresponding lamps. The modular light control devices 33*a*, 33*b* and 33*c* and the lamps 34*a*, 34*b* and 34*c* may be the modular light control device 1 and the lamp 2, respectively, and may also be the above-mentioned or modified aspects thereof. The detailed technological contents may be found hereinabove, and the detailed descriptions thereof will be omitted.

The dimming control device 31 and the modular light control devices 33*a*, 33*b* and 33*c* may also respectively have the network units (not shown) capable of connecting to the network 32, so that the dimming control device 31 may be communicated and connected with the modular light control devices 33*a*, 33*b* and 33*c* through the network 32.

Therefore, the dimming control device 31 can obtain the configurations and working states of the power conversion modules, output modules or control modules of the modular light control devices 33*a*, 33*b* and 33*c* through the network 32, and can control the modular light control devices 33*a*, 33*b* and 33*c* through the network 32 to perform the dimming controls on the lamps 34*a*, 34*b* and 34*c* through the modular light control devices 33*a*, 33*b* and 33*c*, respectively.

In summary, the control module distinguishes the configurations of the power conversion module and the output module in response to different lamps and control methods (control interfaces) according to the modular design characteristic of the modular light control device in the modular light control device, and thus outputs the corresponding control signal to perform the dimming control on the lamp to achieve the better design flexibility. In addition, also due to the modular design, the failure detecting process becomes simpler. In addition, upon detection of the failure of a certain module, only this module needs to be replaced with a new one without replacing the overall control device. Thus, the easy maintenance and the lower cost may be obtained. In addition, in addition to the characteristics and effects of the above-mentioned modular light control device in the dimming control system described herein, the dimming control can be performed on the lamp through the modular light control device, and the configuration and working state of the modular light control device can be obtained at the same time.

Although the embodiments have been described with reference to specific features, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the embodiments described herein.

What is claimed is:

1. A modular light control device for driving at least one lamp, the modular light control device comprising:

a power conversion module having a conversion circuit and a first recognition unit, the conversion circuit receiving a power source and converting the power source into a power signal;

an output module having an output circuit and a second recognition unit;

a control module, and a dimming control device, wherein the dimming control device is communicated and connected with the modular light control device through a network to perform a dimming control on the lamp through the modular light control device, wherein when the control module is electrically connected with the power conversion module and the output module, the control module distinguishes configurations of the power conversion module and the output module through the first recognition unit and the second recognition unit, respectively, and outputs a control signal according to the configuration of the output module, and the output circuit outputs a driving signal to drive the lamp according to the power signal and the control signal, wherein the dimming control device obtains the configuration and a working state of the power conversion module, the configuration and a working state of the output module or the configuration and a working state of the control module of the modular light control device through the network.

2. The modular light control device according to claim 1, wherein the control module further outputs another control signal to control the conversion circuit to output the power signal according to the configuration of the power conversion module.

3. The modular light control device according to claim 1, wherein the first recognition unit or the second recognition unit comprises an address chip, a microcontroller, a pin or a latch working in conjunction with a micro switch, or a combination thereof.

4. The modular light control device according to claim 1, wherein the output circuit has a control interface, and the control signal corresponds to a pattern of the control interface.

5. The modular light control device according to claim 4, wherein the control interface is a digital address lighting interface, a digital multiplex interface, a 0~1V interface, a 0~10V interface or a 1~10V interface.

6. The modular light control device according to claim 1, wherein the network is a wired network or a wireless network.

7. The modular light control device according to claim 6, wherein the wireless network is a Bluetooth mesh network, a WIFI network or a Zigbee network.

8. A dimming control system, comprising:

at least one lamp;

at least one modular light control device, which is electrically connected with the lamp, and comprises a power conversion module, an output module and a control module, the power conversion module has a conversion circuit and a first recognition unit, the conversion circuit receives a power source, and converts the power source into a power signal, the output module has an output circuit and a second recognition unit, and when the control module is electrically connected with the power conversion module and the output module, the control module distinguishes configurations of the power conversion module and of the output module through the first recognition unit and the second recognition unit, respectively, and outputs a control signal according to the configuration of the output module, and the output circuit outputs a driving signal to drive the lamp according to the power signal and the control signal;

a network; and a dimming control device, wherein the dimming control device obtains the configuration and a working state of the power conversion module, the configuration and a working state of the output module, or a configuration and a working state of the control module of the modular light control device through the network, and controls the modular light control device to perform a dimming control on the lamp through the modular light control device through the network.

9. The dimming control system according to claim 8, wherein the control module further outputs another control signal to control the conversion circuit to output the power signal according to the configuration of the power conversion module.

10. The dimming control system according to claim 8, wherein the first recognition unit or the second recognition unit comprises an address chip, a microcontroller, a pin or a latch working in conjunction with a micro switch, or a combination thereof.

11. The dimming control system according to claim 8, wherein the output circuit has a control interface, and the control signal corresponds to a pattern of the control interface.

12. The dimming control system according to claim 11, wherein the control interface is a digital address lighting interface, a digital multiplex interface, a 0~1V interface, a 0~10V interface or a 1~10V interface.

13. The dimming control system according to claim 8, wherein the network is a wired network or a wireless network.

14. The dimming control system according to claim 13, wherein the wireless network is a Bluetooth mesh network, a WIFI network or a Zigbee network.

* * * * *